US008714242B2

(12) United States Patent
Miller

(10) Patent No.: US 8,714,242 B2
(45) Date of Patent: May 6, 2014

(54) ANCHOR ASSEMBLY

(75) Inventor: Todd B. Miller, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 83 days.

(21) Appl. No.: 13/700,236

(22) PCT Filed: Feb. 24, 2012

(86) PCT No.: PCT/US2012/026483
§ 371 (c)(1),
(2), (4) Date: Nov. 27, 2012

(87) PCT Pub. No.: WO2013/126065
PCT Pub. Date: Aug. 29, 2013

(65) Prior Publication Data
US 2013/0220597 A1 Aug. 29, 2013

(51) Int. Cl.
*E21B 23/01* (2006.01)

(52) U.S. Cl.
USPC ..... 166/209; 166/217; 166/211

(58) Field of Classification Search
USPC ..... 166/206, 209, 211, 217
See application file for complete search history.

(56) References Cited

U.S. PATENT DOCUMENTS

| | | | | |
|---|---|---|---|---|
| 7,051,810 | B2 * | 5/2006 | Clemens et al. | 166/301 |
| 7,367,397 | B2 * | 5/2008 | Clemens et al. | 166/301 |
| 7,748,476 | B2 * | 7/2010 | Krueger, V | 175/99 |
| 2004/0031606 | A1 | 2/2004 | Xu | |
| 2005/0056427 | A1 | 3/2005 | Clemens et al. | |
| 2010/0257913 | A1 | 10/2010 | Storm, Jr. et al. | |
| 2011/0073328 | A1 * | 3/2011 | Clemens et al. | 166/387 |
| 2011/0073329 | A1 * | 3/2011 | Clemens et al. | 166/387 |

FOREIGN PATENT DOCUMENTS

WO 02055834 7/2002

OTHER PUBLICATIONS

International Patent Application No. PCT/US2012/026483 , "International Search Report and Written Opinion", Oct. 29, 2012 (11 pages).

* cited by examiner

*Primary Examiner* — Nicole Coy
(74) *Attorney, Agent, or Firm* — Kilpatrick Townsend & Stockton LLP

(57) ABSTRACT

An anchor assembly can anchor a downhole power unit in a wellbore. The anchor assembly can couple to a downhole power unit and can include a coupling member supported by a supporting member in a body. The supporting member can move vertically relative to the body in response to a force and the coupling member can move radially between an expanded position and a retracted position in response to movement by the supporting member. The coupling member in the expanded position can anchor the anchor assembly.

18 Claims, 5 Drawing Sheets

ANCHOR ASSEMBLY

CROSS-REFERENCE TO RELATED APPLICATIONS

This application is a U.S. national phase patent application under 35 U.S.C. 371 of International Patent Application No. PCT/US2012/026483, titled "Anchor Assembly" and filed Feb. 24, 2012, the entirety of which is incorporated herein by reference.

TECHNICAL FIELD OF THE INVENTION

The present invention relates generally to assemblies usable in wellbores of a subterranean formation and, more particularly (although not necessarily exclusively), to anchor assemblies that can anchor downhole power units in wellbores.

BACKGROUND

A downhole power unit can be positioned in a wellbore traversing a hydrocarbon-bearing subterranean formation to facilitate downhole applications on components in the wellbore. The downhole power unit may be a power source that can provide straight, linear pull or push forces for applications downhole.

For example, a downhole power unit can facilitate plug or other component removal from the wellbore. A crown plug may be installed in a subsea wellbore. A crown plug may be a plug that fits into the bore to serve as a secondary barrier against reservoir pressure. A downhole power unit can be positioned close to the crown plug in the bore during a well workover intervention, or other process. Power from the downhole power unit can be used to pull the crown plug, allowing it to be removed from the wellbore.

A downhole power unit is positioned downhole using a "no-go" sleeve that cooperates, such as by resting on, a "no-go" shoulder in a tubing string in the wellbore. Assemblies are desirable, however, that can allow a downhole power unit to be positioned without requiring a "no-go" shoulder or similar mechanism to be present in the tubing string in the wellbore.

SUMMARY

Certain aspects and embodiments of the present invention are directed to an anchor assembly configured for anchoring a downhole power unit or other component in a wellbore.

One aspect relates to an anchor that includes a body, a supporting member, and a coupling member. The body can couple to a downhole power unit in a downhole environment of a subterranean wellbore. The supporting member can be in the body. The coupling member can be supported by the supporting member. The supporting member can be in a first position in response to a force from the downhole power unit on the body to allow the coupling member to be in a retracted position. The supporting member can be in a second position in response to an absence of at least part of the force from the downhole power unit on the body to cause the coupling member to be in an expanded position.

Another aspect relates to an assembly that includes a body, a supporting member, and a coupling member. The supporting member can be in the body. The supporting member includes a first section and a second section. The first section has a greater cross-sectional width than the second section. The coupling member can be supported by the supporting member. The supporting member can be in a first position relative to the body in response to a force and can be in a second position relative to the body in response to an absence of at least of the force. The first section in the second position can cause the coupling member to be in an expanded position. The second section in the first position can allow the coupling member to be in a retracted position.

Another aspect relates to an anchor that includes a body, a supporting member, and a coupling member. The body can couple to a downhole power unit in a wellbore. The supporting member can be in the body and can move vertically relative to the body based on a presence of a force or absence of at least part of the force from the downhole power unit. The coupling member can be supported by the supporting member. The coupling member can move between an expanded position and a retracted position based on vertical movement relative to the body by the supporting member. The coupling member in the expanded position can prevent movement toward a wellhead of a wellbore by the assembly and the downhole power unit in response to pressure in an area of the wellbore subsequent to the downhole power unit.

These illustrative aspects are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
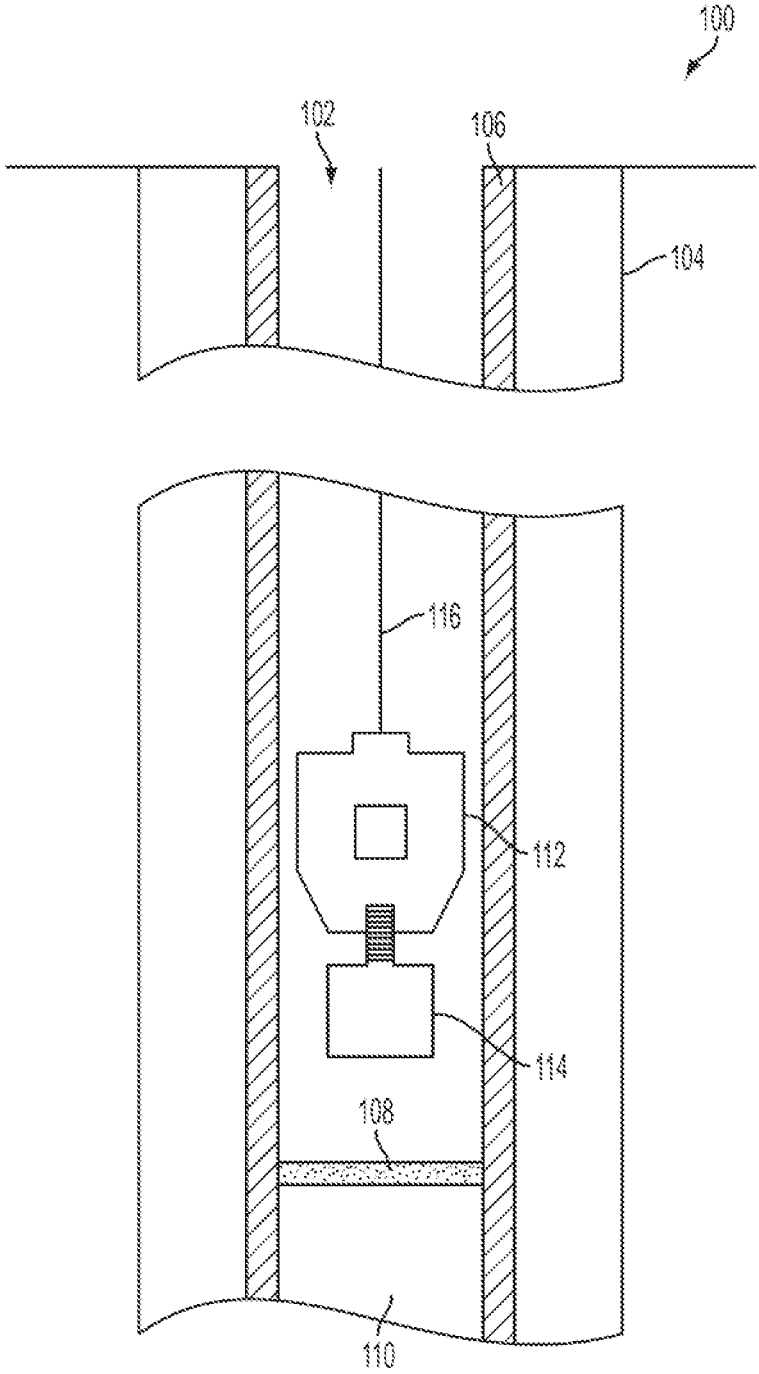
FIG. 1 is a schematic illustration of a well system having an anchor assembly in a retracted position according to one embodiment of the present invention.

Certain aspects and embodiments relate to an anchor assembly that can anchor a downhole power unit in a wellbore. An anchor assembly according to some embodiments can couple to a downhole power unit and can include a coupling member supported by a supporting member in a body. The supporting member can move vertically relative to the body in response to a force and the coupling member can move radially between an expanded position and a retracted position in response to movement by the supporting member.

For example, the supporting member can be in a first position or a second position, based on a force or absence of a force from the downhole power unit. The supporting member in the first position can allow the coupling member to be in a retracted position. A retracted position may be a position that allows movement of the anchor assembly in a tubing string. The supporting member in the second position can cause the coupling member to be in an expanded position. An expanded position may be a position that prevents movement of the anchor assembly in a tubing string in response to wellbore pressures or other forces.

The force from the downhole power unit may be a gravitational force that the downhole power unit transfers to the anchor assembly during positioning in the wellbore. The anchor assembly and downhole power unit can be positioned via a slickline or other suitable mechanism. Other forces may of course be used. When the downhole power unit is positioned proximate (or otherwise relatively close to) a component, such as a plug, downhole, the downhole power unit may transfer less or no gravitational force to the anchor assembly. For example, the plug may prevent the downhole power unit from traversing further downhole. In response to less or no force from the downhole power unit, the supporting member can move vertically to the second position and cause the coupling member to move radially to an expanded position. The coupling member in the expanded position can grip an inner diameter of a tubing or riser, or couple to a coupling device in the inner diameter of the tubing, to prevent movement of the anchor assembly.

Subsequent to plug extraction, the anchor assembly and downhole power unit can be lifted toward a wellhead. The presence of a force from the downhole power unit during lift can cause the supporting member to move vertically relative to the body to the first position and allow the coupling member to move inwardly to the retracted position to facilitate removal from the wellbore.

A coupling member according to some embodiments may include keys, such as serrated or "no-go" keys on an outer surface that are configured for coupling to tubing or to a coupling device in tubing when the coupling member is in an expanded position. A supporting member according to some embodiments may be a mandrel or similar component having a coupling device, such as a fish neck, for coupling to a pulling tool associated with a slickline.

A supporting member may include an offset (tapered and/or indented) outer surface and a coupling member may include a partial complimentary offset (tapered and/or indented) inner surface. The outer and inner surface can cooperate to cause the coupling member to be in the expanded position when the supporting member is in the second position and to be in the retracted position when the supporting member is in the first position.

Anchor assemblies according to some embodiments can include additional components. For example, an assembly can include a downhole power unit connector and a spring. The downhole power unit connector can be associated with (such as by being coupled to or integral with) the body. The spring can compress in response to the force transferred from the downhole power unit to assist in causing the supporting member to be first position.

Certain anchor assemblies can allow downhole power units to be positioned to a desired depth without relying on shoulders or other coupling components in a tubing string. Although described with respect to downhole power units, anchor assemblies according to some embodiments can be used with other components in wellbores to anchor the components.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

Figure 2:
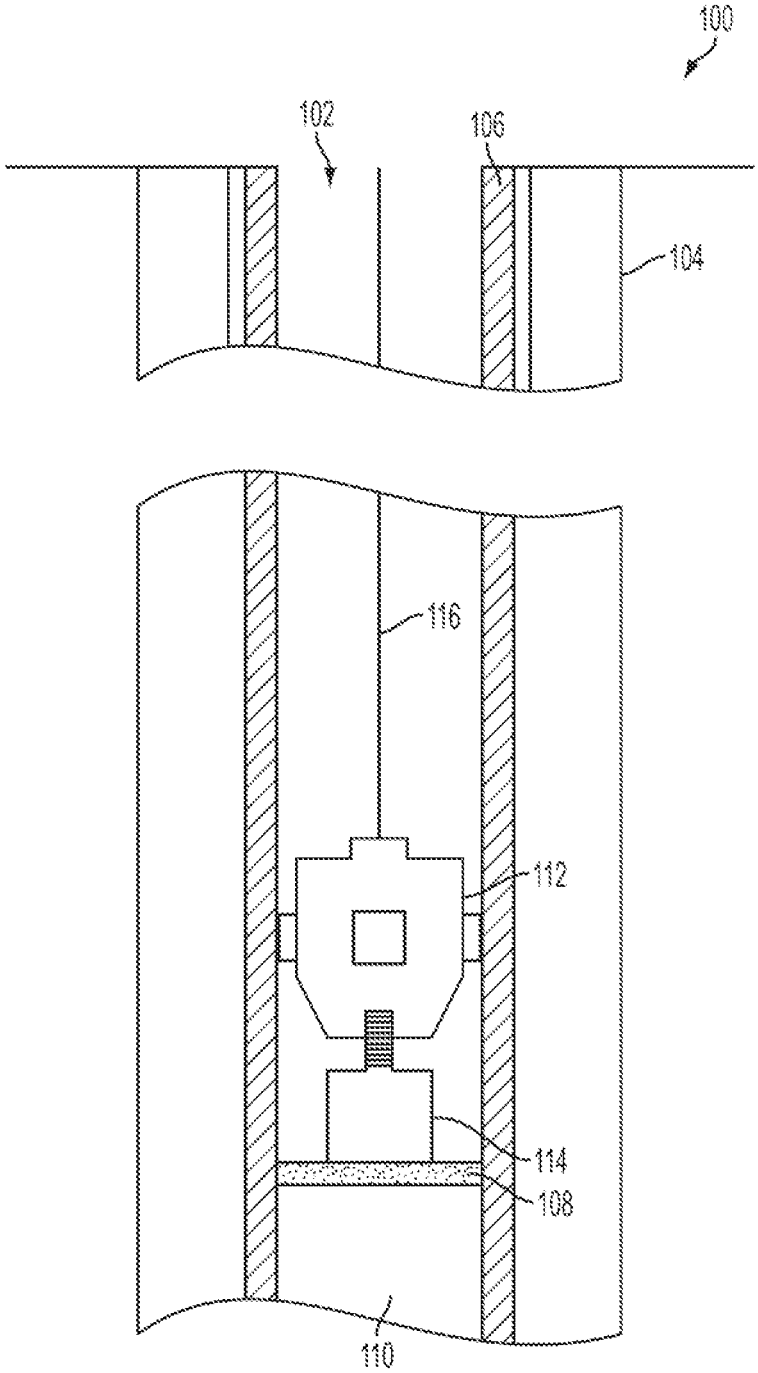
FIG. 2 is a schematic illustration of the well system of FIG. 1 in which the anchor assembly is in an expanded position according to one embodiment of the present invention.

FIGS. 1 and 2 depict a well system 100 with an anchor assembly according to one embodiment. The well system 100 includes a bore that is a wellbore 102 extending through various earth strata. Although the wellbore 102 is substantially vertical, anchor assemblies can also be used in deviated and substantially horizontal sections of wellbores. The wellbore 102 includes casing string 104, which may be cemented at an upper portion of the wellbore 102, such as proximate a wellhead. The casing string 104 extends through the wellbore 102.

A tubing string 106 extends from the surface within wellbore 102. The tubing string 106 can provide a conduit for formation fluids to travel from to the surface. Flow control devices, packers and production tubular sections in various production intervals adjacent to the formation are not shown, but can be positioned in or with the tubing string 106.

A plug 108, which may be crown plug, is in the tubing string 106. The plug 108 may be positioned in the tubing string 106 after well production to be a barrier against reservoir pressure in an area 110 of the wellbore 102 subsequent to the plug 108.

Disposed in the tubing string 106 is an anchor assembly 112 coupled to a downhole power unit 114 and a line 116, such as a slickline. FIG. 1 depicts the anchor assembly 112 being positioned downhole via the line 116. As the anchor assembly 112 is being positioned downhole, the downhole power unit 114 can transfer a force to the anchor assembly 112, which can cause the anchor assembly 112 to be in a retracted position. For example, a gravitational force can affect the downhole power unit 114, which can transfer at least some of the gravitational force to the anchor assembly 112 and result in the anchor assembly experiencing an additional force in a direction toward the area 110.

FIG. 2 depicts the downhole power unit 114 landed on the plug 108. When the downhole power unit 114 is landed on the plug, the force transferred from the downhole power unit 114 to the anchor assembly 112 may be reduced or eliminated. In response to the force being reduced or eliminated, the anchor assembly 112 can be in an expanded position. The anchor assembly 112 in the expanded position can prevent the downhole power unit 114 from moving in response to pressures in the wellbore, such as pressure in the area 110.

Figure 3:
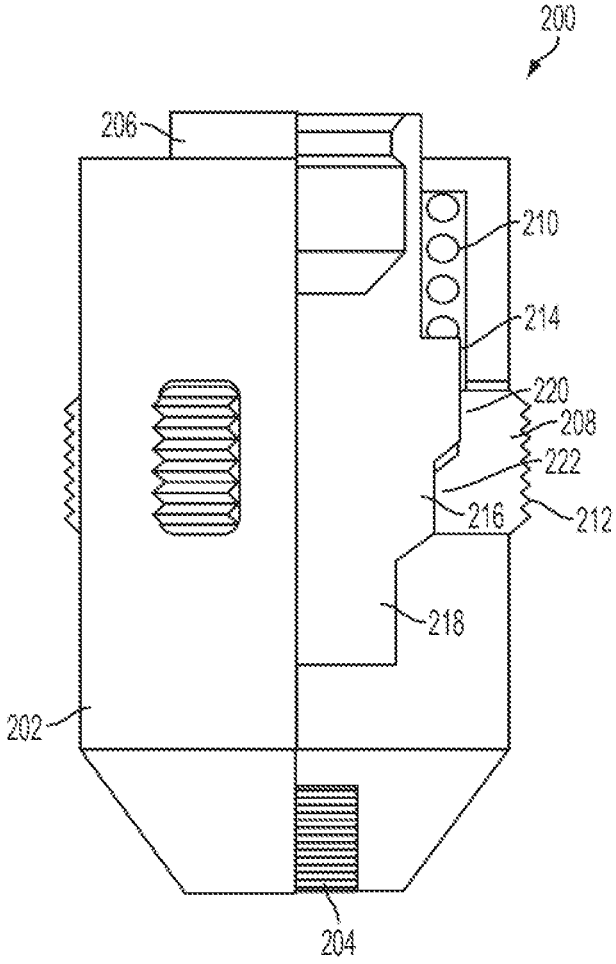
FIG. 3 is a partial cross-sectional view of an anchor assembly having serrated keys according to one embodiment of the present invention.
Figure 4:
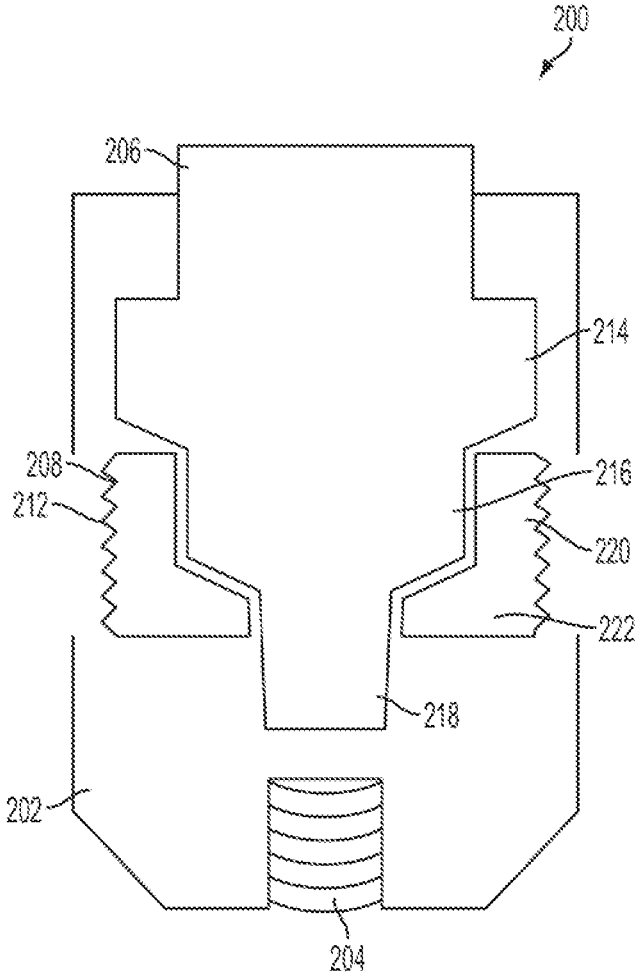
FIG. 4 is a cross-sectional view of part of the anchor assembly of FIG. 3 in a retracted position.

FIG. 3 depicts a partial cross-section of an anchor assembly 200 according to one embodiment. FIG. 4 depicts a cross-section of part of the anchor assembly 200 according to one embodiment. The anchor assembly 200 includes a body 202, a connection member 204, a supporting member 206, a coupling member 208, and a spring 210.

The body 202 may be a housing made from a rigid material that can house the components of the anchor assembly 200. The body 202 can include openings at ends of the body to provide for the connection member 204 and part of the supporting member 206 for coupling to a pulling tool or line. The body 202 can also include one or more openings in a radial surface through which part of the coupling member 208 can be located in an expanded position.

The connection member 204 can couple to a downhole power unit or other component. In some embodiments, the connection member 204 and the body 202 are integral. In other embodiments, the connection member 206 is a separate from, but coupled to, the body 202.

The supporting member 206 may be a mandrel or other component that can move vertically with respect to the body 202 in response to a force or absence (or reduction) of a force from a downhole power unit. For example, the supporting member 206 can be in a first position in response to a force from the downhole power unit in a downhole direction that is applied to the body 202 such that the supporting member 206 is in the first position relative to the body 202. The supporting member 206 can be in a second position relative to the body 202 that is vertically different than the first position in response to an absence or reduce of the force from the downhole power unit. The supporting member 206 can include an end that can couple to a tool string, such as a pulling tool or line.

The supporting member 206 in the first position can allow the coupling member 208 to be in a retracted position. FIG. 4 depicts coupling member 208 in the retracted position. In the retracted position, the coupling member 208 can be inward of the body 202. The supporting member 206 in the second position can cause the coupling member 208 to be in an expanded position. FIG. 3 depicts the coupling member 208 in the expanded position. In the expanded position, the coupling member 208 can extend in a radial direction from the body 202.

The spring 210 can assist in moving the supporting member 206 vertically relative to the body 202. In some embodiments, the spring 210 can compress in response to the force from the downhole power unit as transmitted through the body 202 to the spring 210. When compressed, the spring 210 can allow the supporting member 206 to be in the first position, such as by moving from an area within the body 202 to which the supporting member 206 can move in the first position. In response to an absence or reduce of the force, the spring 210 can release and assist in causing the supporting member 206 to be in the second position. In some embodiments, the anchor assembly 200 does not include the spring 210, as depicted in FIG. 4, for example.

The coupling member 208 includes keys 212 that may be serrated keys having upward and/or downward facing serrations. The keys 212 in the expanded position can grip an inner diameter of a tubing string or rise to prevent movement by the anchor assembly 200 and downhole power unit.

An outer wall of the supporting member 206 can include offset, or indented, sections that can cooperate with an offset inner wall of the coupling member 208 to cause the coupling member to be in a retracted position or an expanded position. The coupling member 208 can include offset, or indented, portions that can cooperate with the sections of the supporting member 206. The supporting member 206 can include three sections 214, 216, 218. The first section 214 can have a greater cross-sectional width than the second section 216. The second section 216 can have a greater cross-sectional width than the third section 218. A tapered section may be between the first section 214 and the second section 216. A second tapered section may be between the second section 216 and the third section 218. The inner wall of the coupling member 208 can include two portions 220, 222. The first portion 220 can have a lower width than the second portion 222. A tapered portion may be between the first portion 220 and the second portion 222.

In the first position as shown in FIG. 4, the first section 214 can be above the coupling member 208, the second section can be located proximate the first portion 220, and the third section 218 can be located proximate the second portion 222, to allow the coupling member 208 to be in the retracted position. In the second position as shown in FIG. 3, the first section 214 is located proximate the first portion 220 and the second section 216 is located proximate the second portion 222, to cause the coupling member 208 to be in the expanded position. The tapered sections and tapered portion can facilitate movement of the supporting member 206 with respect to the coupling member 208. The tapered sections and tapered portion may be tapered at any angle. An example of a suitable angle is one in the range of one to ten degrees, such as a range of two to five degrees.

Figure 5:
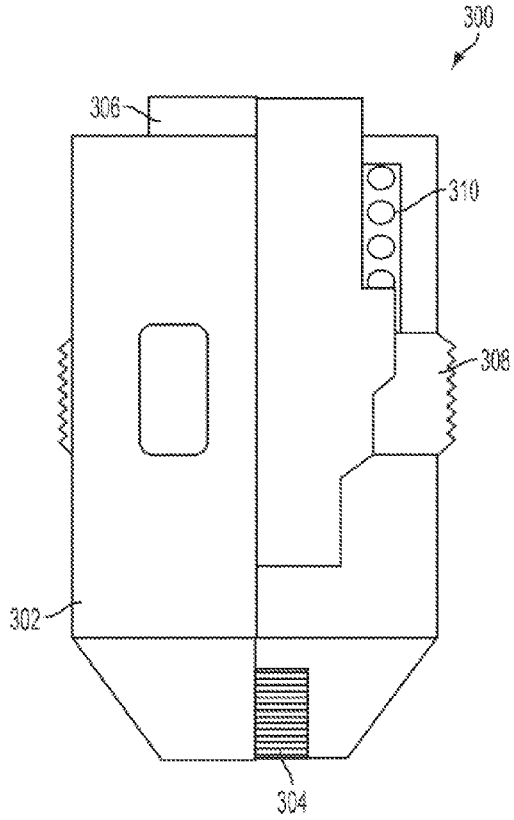
FIG. 5 is a partial cross-sectional view of an anchor assembly having "no-go" keys according to one embodiment of the present invention.

FIG. 5 depicts a partial cross-sectional view of an anchor assembly 300 according to a second embodiment. The anchor assembly includes a body 302, a connection member 304, a supporting member 306, a coupling member 308, and a spring 310. The body 302, connection member 304, supporting member 306, and spring 310 are similar to corresponding components described in connection with FIGS. 3-4. The coupling member 308 includes "no-go" keys instead of serrated keys. The "no-go" keys are configured to couple to a coupling device that may be located in a tubing string or riser to anchor the anchor assembly and downhole power unit.

Figure 6:
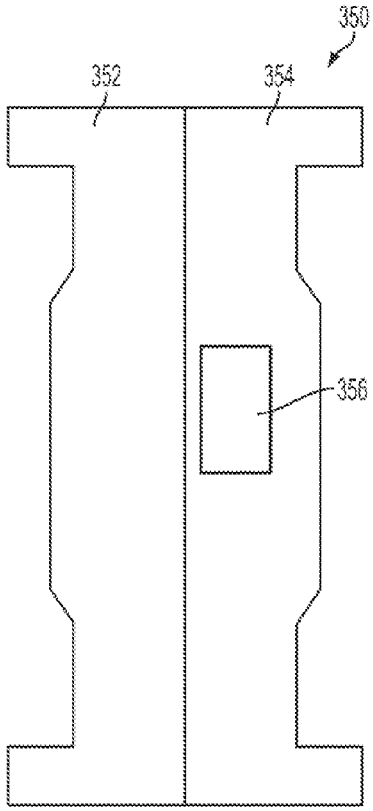
FIG. 6 is a side view of a joint capable of being disposed in the tubing string and cooperating with the "no-go" keys of the anchor assembly of FIG. 5 according to one embodiment.

FIG. 6 depicts a coupling device 350 that can be coupled to, or integrated with, a tubing string or riser. The coupling device 350 is a flanged "no-go" joint having an outer diameter 352 and an inner diameter 354.

Between the outer diameter 352 and inner diameter 354 is an enlarged diameter 356 that can receive "no-go" keys from a coupling member, such as coupling member 308 of FIG. 5 when the coupling member 308 is in an expanded position. In other embodiments, the coupling device is a nipple or other similar mechanism having a profile.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An anchor, comprising:

a body configured for coupling to a downhole power unit in a downhole environment of a subterranean wellbore;

a supporting member in the body; and a coupling member supported by the supporting member, wherein the supporting member is configured to be in a first position in response to a force from the downhole power unit on the body to allow the coupling member to be in a retracted position and to be in a second position in response to an absence of at least part of the force from the downhole power unit on the body when the downhole power unit lands on a seal to cause the coupling member to be in an expanded position.

2. The anchor of claim 1, wherein the coupling member comprises serrated keys configured to secure, when in the expanded position, the anchor to an inner diameter of a tubing.

3. The anchor of claim 1, wherein the coupling member in the expanded position is configured to secure the anchor to a coupling device in an inner diameter of a tubing.

4. The anchor of claim 1, wherein the body comprises:

a connection member for coupling to the downhole power unit; and an opening through which at least part of the coupling member is configured to be located in the expanded position, wherein the anchor further comprises a spring configured for compressing in response to the force from the downhole power unit to allow the supporting member to be in the first position.

5. The anchor of claim 1, wherein the supporting member comprises a first section and a second section, the first section being integral with the second section and having a greater cross-sectional width than the second section, wherein the first section in the second position is configured to cause the coupling member to move radially outward to the expanded position, wherein the second section in the first position is configured to allow the coupling member move radially inward to the retracted position.

6. The anchor of claim 5, wherein the coupling member comprises a first portion, wherein the first portion is configured to be supported by the first section in the expanded position and to be allowed to move inward toward the second section in the retracted position.

7. The anchor of claim 6, wherein the supporting member comprises a third section integral with the first section and the second section, the third section having a smaller cross-sectional width than the second section, wherein the coupling member comprises a second portion having a greater cross-sectional width than the first portion, the second portion being configured to move toward the third section in the retracted position and to be supported by second section in the expanded position.

8. The anchor of claim 7, wherein the supporting member comprises:

a first inwardly tapered section between the first section and the second section; and a second inwardly tapered section between the second section and the third section, wherein the coupling member comprises an outwardly tapered portion between the first portion and the second portion.

9. The anchor of claim 1, wherein the coupling member in the expanded position is configured to prevent movement toward a wellhead of the wellbore by the anchor and the downhole power unit in response to pressure in an area of the wellbore subsequent to the downhole power unit.

10. The anchor of claim 1, wherein the supporting member is configured to couple to a tool string.

11. The anchor of claim 1, wherein the first position is vertically different than the second position relative to the body.

12. An assembly, comprising:

a body;

a supporting member in the body, the supporting member comprising a first section and a second section, the first section having a larger cross-sectional width than the second section;

a coupling member supported by the supporting member, wherein the supporting member is configured to be in a first position relative to the body in response to a force and to be in a second position relative to the body in response to an absence of at least part of the force when a downhole power unit lands on a seal, the first section in the second position being configured to cause the coupling member to be in an expanded position, the second section in the first position being configured to allow the coupling member to be in a retracted position.

13. The assembly of claim 12, wherein the first section is integral to the second section, wherein the body is configured for coupling to the downhole power unit in a downhole environment of a subterranean wellbore, wherein the force is from the downhole power unit.

14. The assembly of claim 13, wherein the body comprises a connection member for coupling to the downhole power unit.

15. The assembly of claim 13, wherein the coupling member in the expanded position is configured to prevent movement toward a wellhead of the wellbore by the assembly and the downhole power unit in response to pressure in an area of the wellbore subsequent to the downhole power unit.

16. The assembly of claim 12, wherein the coupling member comprises serrated keys configured to secure, when in the expanded position, the assembly to an inner diameter of a tubing.

17. The assembly of claim 12, wherein the coupling member in the expanded position is configured to secure the assembly to a coupling device in an inner diameter of a tubing.

18. The assembly of claim 12, wherein the coupling member comprises:

a first portion;

a second portion having a greater cross-sectional width than the first portion; and an outwardly tapered portion between the first portion and the second portion, wherein the supporting member comprises:

a third section integral with the first section and the second section, the third section having a smaller cross-sectional width than the second section;

a first inwardly tapered section between the first section and the second section; and a second inwardly tapered section between the second section and the third section, wherein the first portion is configured to be supported by the first section in the expanded position and to be allowed to move inward toward the second section in the retracted position, wherein the second portion is configured to move toward the third section in the retracted position and to be supported by second section in the expanded position.

* * * * *